United States Patent [19]

Gourmel et al.

[11] Patent Number: 4,690,199

[45] Date of Patent: Sep. 1, 1987

[54] APPARATUS FOR THE ROTARY SUPPLY OF MOLTEN CAST-IRON TO AN INSTALLATION FOR THE VERTICAL CONTINUOUS CASTING OF A PIPE FROM SPHEROIDAL GRAPHITE CAST-IRON

[75] Inventors: Yves Gourmel; Michel Pierrel, both of Pont-A-Mousson, France

[73] Assignee: Pont-a-Mousson S.A., Nancy, France

[21] Appl. No.: 806,318

[22] Filed: Dec. 9, 1985

[30] Foreign Application Priority Data

Dec. 7, 1984 [FR] France ..... 84 18862

[51] Int. Cl.[4] ..... B22D 11/00

[52] U.S. Cl. ..... 164/421; 164/504; 164/464

[58] Field of Search ..... 164/504, 502, 415, 421, 164/422, 439, 464, 466

[56] References Cited

U.S. PATENT DOCUMENTS 2,762,096 9/1956 Wittmoser .
4,355,680 10/1982 Frantzreb ..... 164/421

FOREIGN PATENT DOCUMENTS 2749405 5/1979 Fed. Rep. of Germany ..... 164/415
493449 6/1916 France .
1122833 9/1956 France .
7616285 12/1977 France .
2422460 12/1979 France ..... 164/502
2537470 6/1984 France ..... 164/465
57-85653 5/1982 Japan ..... 164/464
58-23540 2/1983 Japan ..... 164/421
1187995 4/1970 United Kingdom ..... 164/273

*Primary Examiner*—Nicholas P. Godici
*Assistant Examiner*—G. M. Reid
*Attorney, Agent, or Firm*—Sughrue, Mion, Zinn, Macpeak and Seas

[57] ABSTRACT

Installation comprising a reservoir crucible 11, 12 for molten cast-iron F with step-by-step extraction of a pipe T produced from the crucible comprising a cooled die. To obtain a cast-iron pipe of uniform thickness over its entire circular periphery, despite the absence of a core, the molten cast-iron F is set in slow rotation in the crucible by the tangential supply of molten cast-iron with a low rate of flow through a tangential orifice 18, by the rotation of a magnet 36 disposed in a hollow central relief 17 upstanding from the base of the crucible, by the rotation of paddle arms 44 disposed in the molten iron, or by the tangential injection of an inert gas.

4 Claims, 14 Drawing Figures

APPARATUS FOR THE ROTARY SUPPLY OF MOLTEN CAST-IRON TO AN INSTALLATION FOR THE VERTICAL CONTINUOUS CASTING OF A PIPE FROM SPHEROIDAL GRAPHITE CAST-IRON

BACKGROUND OF THE INVENTION

The present invention relates in general to the continuous vertical bottom casting of a pipe from spheroidal graphite cast-iron, without using a core for forming the cavity of the pipe, and more particularly to an apparatus for supplying molten cast-iron to a tubular die providing the external shape of the pipe, either from a siphon unit (bottom supply), or from a casting ladle under low gas pressure.

The rotary supply of molten casting metal, for example cast-iron, has been known for a long time, for example from French Pat. No. 493,449, with a view to centrifuging the molten metal and obtaining a hollow body and, a little more recently, from U.S. Pat. No. 2,762,096 with a view to homogenizing, i.e. distributing the molten metal uniformly inside the continuous casting mould or ingot-mould. Such rotary supply does not set the bath in rotation, however, owing to the fact that the cast-iron drops vertically without a horizontal component of the speed of rotation.

More recently still, in French Pat. No. 2,352,612, an installation is described for setting the molten cast-iron in rotation at a centrifugation speed using a magnetic field rotating about a crucible containing the molten cast-iron, with a view to obtaining a cast-iron tube by continuous bottom casting, without using a core.

But the problem is posed of setting a mass of molten cast-iron in rotation at a speed lower than the centrifugation speed, for the purpose of homogenizing and regularising the supply, inside a cooled and stationary tubular die, providing the external shape of the tube to be produced, without using a core. The problem is one of maintaining a permanent rotary movement of the molten cast-iron in the stationary and cooled tubular die in order to regularise the thickness of the cast-iron tube obtained on each circular section and thus to obtain internal and external walls which are perfectly concentric.

SUMMARY OF THE INVENTION

The invention relates to a device for supplying a fixed tubular die, which solves this problem.

This rotary supply device of the invention, of the type comprising a cooled die constituting a reservoir crucible for the molten cast-iron, a crucible from which a spheroidal graphite cast-iron pipe is to be produced, is characterised in that it comprises at least in the lower part of the reservoir crucible impulsion means or means for setting the mass of molten cast-iron contained in the reservoir crucible in rotation with a horizontal component of the speed of rotation.

According to one embodiment of the invention, the impulsion means or rotation means are hydraulic means. The apparatus of the invention is thus characterised in that it comprises, at the base of the reservoir crucible, at least one tangential inlet pipe for molten cast-iron which opens into the reservoir crucible for molten cast-iron.

This tangential supply of molten cast-iron may be subjected to rhythmic pulsations which promote a slow rotation of the molten cast-iron.

These rotation means may also be gaseous, with the use of a gaseous fluid which is chemically inert with regard to cast-iron (argon, nitrogen).

According to another embodiment, the rotation means are magnetic. In this case, the supply apparatus of the invention is characterised in that it comprises magnetic means housed inside a central hollow relief providing with the cooled die an annular chamber for molten cast-iron, over a height greater than that of the annular volume of molten cast-iron, in order to create a magnetic field rotating about the axis of the die and of the central relief over the entire height of the annular mass of molten cast-iron.

In another embodiment, the impulsion means or rotation means are mechanical. In this case, the rotary supply apparatus of the invention is characterised in that it comprises inside the central hollow relief, along the axis and through the cavity of the latter, a rotary vertical shaft comprising at its upper end vertical arms of refractory material immersed in the annular mass of molten cast-iron with a view to setting the latter in rotation.

DETAILED DESCRIPTION OF THE PREFERRED EMBODIMENTS

Figure 1:
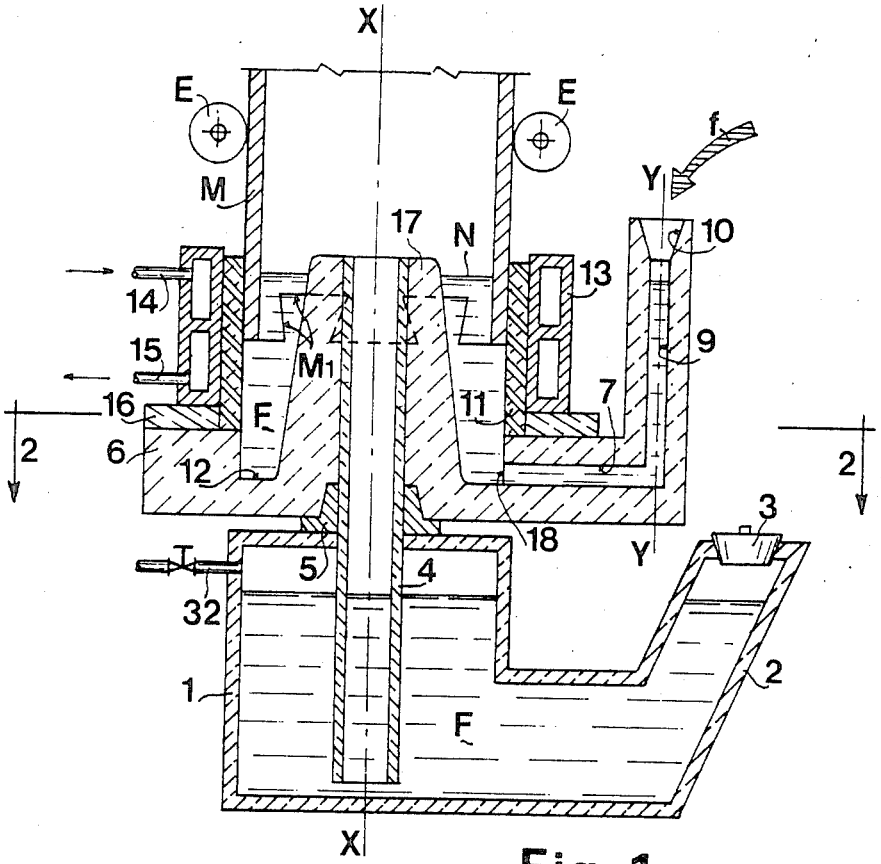
FIG. 1 is a diagrammatic sectional view of the supply apparatus according to the invention with a tangential supply of molten metal, in addition to an axial supply.

According to the embodiment of FIG. 1, the invention is applied to the continuous bottom casting of a pipe from cast-iron F, the said pipe being thin owing to the fact that the thickness/diameter ratio is low, less than 10%. The thickness of the body, i.e. of the tubular part adjacent the socket, does not exceed 15 mm for a diameter of 1000 mm, 8 mm for a diameter of 300 mm and 5 mm for a diameter of 80 mm.

The installation comprises:

a supply of molten cast-iron at low gas pressure, a siphon unit for the tangential supply of a reservoir crucible with molten cast-iron which constitutes the aforesaid hydraulic impulsion or rotation means for the molten cast-iron and for maintaining this rotation, a reservoir crucible constituted by a cooled tubular die, an extractor (not shown) for the pipe which is formed.

(1) Axial supply of molten cast-iron at low gas pressure

A pressurised casting ladle 1 having an oblique teapot type filling spout 2, closed by a cover 3, contains molten cast-iron F. A vertical casting tube 4 of refractory material passes through the upper wall of the closed teapot type ladle 1. The tube 4 is immersed virtually to the bottom of the ladle 1 and rises well above the upper wall of the ladle 1 in order to open into the reservoir crucible of the cooled die, described hereafter, below which the ladle 1 is placed. The bottom casting tube 4 is connected in an air-tight manner to the upper wall of the teapot type ladle 1 by a frustoconical nozzle 5 comprising a flange, on the axis XX like the tube 4. The frustoconical nozzle 5 also serves for the connection of the bottom casting tube 4 on the axis XX to the siphon unit described hereafter.

(2) Tangential supply of molten cast-iron by a siphon unit

A base 6, of refractory material, for example of the silico-aluminous type, comprises internally the lower part of an L-shaped casting pipe 7 comprising a horizontal or slightly oblique leg and a vertical tangential orifice 18 for a tangential bottom supply to the reservoir crucible described hereafter. The tangential orifice 18 has a cross-sectional passage less than that of the bottom casting tube 4. The base 6 serves as a support for the vertical inlet pipe constituted by a vertical passage 9 on the axis YY parallel to the axis XX of the vertical casting tube 4. The vertical passage 9 is connected at its lower end to the horizontal leg of the casting pipe 7 and terminates at its upper end in a casting funnel 10 on the axis YY. The height of the passage 9 is equal to that of the reservoir crucible or of the die discussed hereafter. The passage 9 and the reservoir crucible form communicating vessels. The horizontal casting pipe 7 has a diameter less than that of the tube 4. This supply arrangement 6-7-9-10 is referred to as the siphon unit.

(3) The reservoir crucible constituted by the cooled die

Along the axis XX of the axial bottom casting tube, the base 6 of the siphon unit supports a crucible constituted by a tubular graphite die 11 on the axis XX and by the base 6 itself constituting a vat bottom 12 which is not cooled.

The die 11 is cooled externally by a jacket 13, for example of copper, comprising a circulation of cooling water which enters through a pipe 14 and leaves through a pipe 15. The jacket 13, in contact with the die 11, surrounds the die 11 over virtually its entire height, however with the exception of its lower part which remains uncooled. For this purpose, an annular plate 16 for supporting the jacket 13, of refractory material for example of the silicoaluminous type, which is therefore thermally insulating, is interposed between the jacket 13 and the base 6, in order to prevent cooling of the base 6 by the cooling jacket 13.

In this example, but not necessarily, the volume of the reservoir crucible constituted by the die 11 and the base 6 is substantially reduced and restored to an annular volume by a central relief 17 on the axis XX, which is coaxial with the bottom casting tube 4 and through which this tube passes. The use of the central relief 17 is particularly advantageous for the casting of a tube of large diameter. The central relief 17 forms an integral part of the siphon unit 6-7-9-10 and of the reservoir crucible constituted by the combination of the base 6 and of the cooled tubular die 11. The central frustoconical relief 17 has a large base, below the support constituted by the base 6, of diameter substantially less than the inner diameter which one wishes to obtain for the tube to be formed. The small upper base of the central frustoconical relief 17 thus also has a diameter substantially less than that of the cavity of the pipe to be obtained.

It is advantageous that the relief 17 is higher than the die 11 since this makes it possible to limit the volume of molten cast-iron to an annular space over the entire height of the die 11, whereas if the central relief 17 were clearly lower than the die 11 there would be molten cast-iron above the top of the relief 17 and consequently a useless excess of molten cast-iron.

The central relief 17 is open from one end to the other from its upper side as far as the lower side of the base 6 in the form of a cylindrical cavity for the passage of the complementary casting tube of the frustoconical nozzle 5 which fits in this socket. The tangential orifice 18 of the L-shaped casting pipe 7 opens out at the lower end, i.e. close to the bottom of the annular volume of the reservoir crucible 6–11, in a tangential manner. Preferably, whereas the cross-section of the vertical casting tube 4 is as great as possible (axial supply of molten cast-iron under gas pressure), the cross-section of the horizontal casting pipe 7 as far as the tangential orifice 18, which is limited by the width of the annular space between the cooled die 11 and the central relief 17, at the base of the reservoir crucible is substantially less than that of the axial bottom casting tube 4.

(4) The extractor for the cast-iron pipe

The extractor for the pipe being formed is not shown. It comprises means for gripping the rising cast-iron pipe, for example a tubular manikin or steel sleeve, the gripping means or manikin M being engaged between rollers E for guiding and entraining it upwards. For the attachment or engagement of the rising tube on the manikin M, the latter comprises a dove-tailed indentation M1.

Operation

The explanation of the operation of the apparatus of the invention is limited hereafter to setting the molten cast-iron in rotation inside the reservoir crucible i.e. in the annular space comprised between the die 11 and the central relief 17, in view of the fact that once the molten cast-iron has been set in rotation, maintaining this rotation is carried out in the same manner, and the processes of the step-by-step ascent and solidification of the body of the pipe being formed are known per se and form no part of the invention.

(1) Supply of molten cast-iron: this supply is carried out in two stages, (a) Main non-rotary supply, under gas pressure, in order to fill the reservoir crucible comprising the die 11 and base 12 with cast-iron F:

Pressurised fluid is introduced through the pipe 32 into the teapot type ladle 1. The cast-iron F rises above the central relief 17, pours into the annular space between the central relief 17 and the die 11 and rises in the vertical passage 9 where molten cast-iron is introduced from the orifice 18 and the horizontal leg of the casting pipe 7.

The introduction of molten cast-iron F into the annular volume of the reservoir crucible and the vertical passage 9 is continued until the level of molten cast-iron F is at N in the upper part of the die 11, just below the upper edge of the die 11 and the top of the central relief 17. By comparison with the following tangential supply, the axial supply has a high rate of flow.

(b) Auxiliary tangential supply of molten cast-iron, with a low rate of flow (hydraulic means for rotary impulsion):

This supply for renewing and setting the molten cast-iron in rotation does not take place immediately after the preceding supply with a high rate of flow, since the upper level N is reached before beginning the casting of a pipe T, but at a moment which will be discussed hereafter. This tangential supply for renewal having a low rate of flow, which takes place in the direction of arrow f through the vertical passage 9 and through the tangential orifice 18 will be described hereafter. In comparison with the preceding axial supply, the tangential supply has a low rate of flow but a high speed.

(2) Casting of the body of the pipe from cast-iron and extraction of the pipe as it is formed:

The manikin M is introduced into the die 11 from the top. Whereas the die 11 is not cooled at its lower end, on the contrary it is cooled over the major part of its height as far as its upper end by the cooling jacket 13. The cast-iron thus solidifies in contact with the die 11, over an increasing thickness up to the manikin M in contact with which it solidifies and to which it becomes attached by the indentation M1. The manikin M is then drawn upwards by rollers E for entrainment and guidance. The rollers E driven by a stepping motor cause the manikin M to rise in jerks. The manikin M draws the part of solidified cast-iron upwards, step-wise. When the manikin M has drawn an initial portion of cast-iron pipe upwards by a height sufficient to be engaged in turn by the entrainment rollers E, the manikin M becomes useless and may be separated at any time from the pipe. During the formation of this initial portion of the pipe, it was necessary to pour molten cast-iron into the funnel 10 in order to replace or renew the quantity of cast-iron which served to form the initial portion of pipe. One thus takes care to keep the level N of molten cast-iron constant during extraction, slightly below the upper part of the die 11, at a height where the cast-iron is still cooled by the jacket 13.

Figure 3:
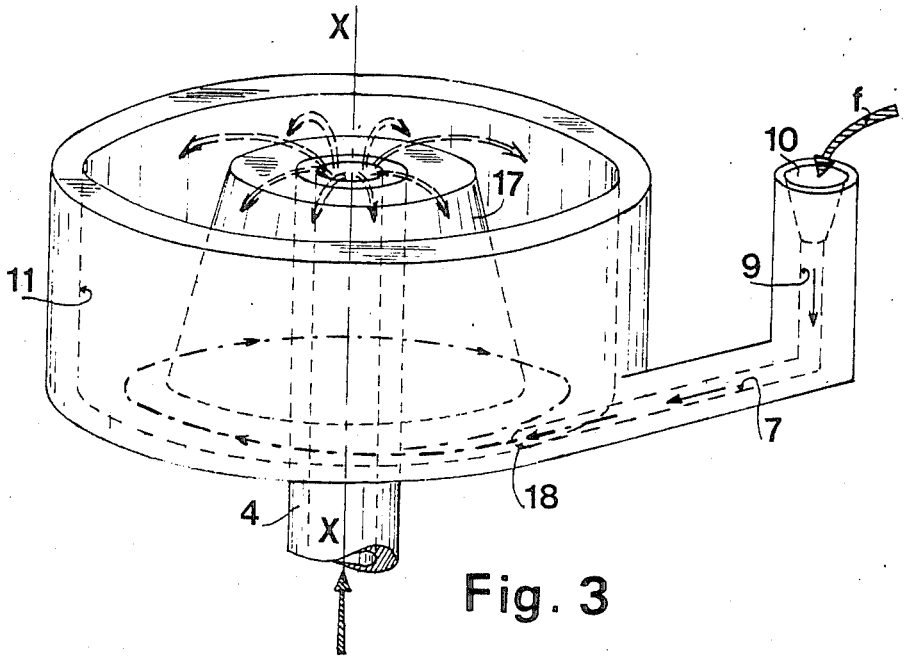
FIG. 3 is a diagrammatic perspective view illustrating the tangential supply in addition to the axial supply of the apparatus of FIG. 1, FIGS. 4, 5 and 6 are diagrammatic sectional views similar to FIG. 1, of variations of the apparatus of the invention respectively with magnetic, mechanical and gaseous means for setting the cast-iron in rotation.

This tangential supply takes place according to the diagram of FIG. 3. The molten cast-iron entering tangentially through the orifice 18 at the bottom of the annular space comprised between the die 11 and the central relief 17 has a sufficient horizontal speed in order to set the entire annular mass of molten cast-iron F in rotation, progressively at low speed and in order to maintain this rotation of the molten cast-iron. One thus takes care to keep the level N of molten cast-iron constant throughout the extraction of the pipe, slightly below the upper part of the jacket 11, at a height where the cast-iron is still cooled by the cooling jacket 13, whilst rotating the cast-iron F slowly about the axis XX.

By causing the cast-iron to rotate slowly in this way about the axis XX, the temperature of the molten cast-iron contained in the reservoir crucible 11-12 is homogenized and the thickness of the pipe is regularised on the circular section of the body of the pipe being formed. Such circular section thus has inner and outer walls which are perfectly concentric.

The upwards extraction of the solidified pipe is carried out discontinuously, step-by-step. The initial portion of the pipe body is elongated by each ascending stroke imparted by the rollers E along a constant thickness over the entire circular section of the body, by virtue of the slow rotation due to the tangential supply of molten cast-iron through the vertical passage 9 and the tangential orifice 18.

It will be recalled that homogenization of the temperature of the bath is to a certain extent linked with the regularisation of thickness of the body formed with slow rotation of the molten cast-iron on account of the solidification process of the molten cast-iron: the cast-iron is a eutectic liquid whereof the solidifiation is very different from that of steels: at the time of solidification, the cast-iron does not undergo the phenomenon of segregation and does not comprise a solid and liquid mixture. The cast-iron is a eutectic liquid which passes suddenly from the liquid phase to the solid phase, without any mixing of the two phases and without dendrites. The applicant has ascertained that lower thicknesses were obtained where the bath was hotter and higher thicknesses by homogenizing and regularising the temperature of the bath by rotation of the molten cast-iron. This rotation also produces a more regular thickness on a circular section.

When a sufficient length of body for the pipe has been obtained in this way, one no longer pours molten cast-iron into the funnel 10 and one proceeds with the rapid emptying of the annular space between the die 11 and the central relief 17, for example through a lower orifice which is not shown and from which the stopper is removed. It is then sufficient to completely raise the pipe formed above the die 11.

Figure 2:
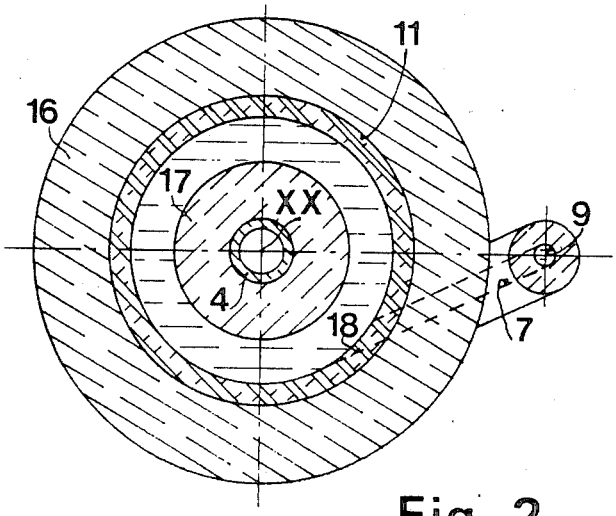
FIG. 2 is a sectional view on line 2—2 of FIG. 1.

In order to rotate the molten cast-iron slowly with a view to homogenizing the temperature of the bath and regularizing the thickness of the pipe over its circular section, it is possible to use other means, so called hydraulic means, than those of FIGS. 1 to 3.

Figure 4:
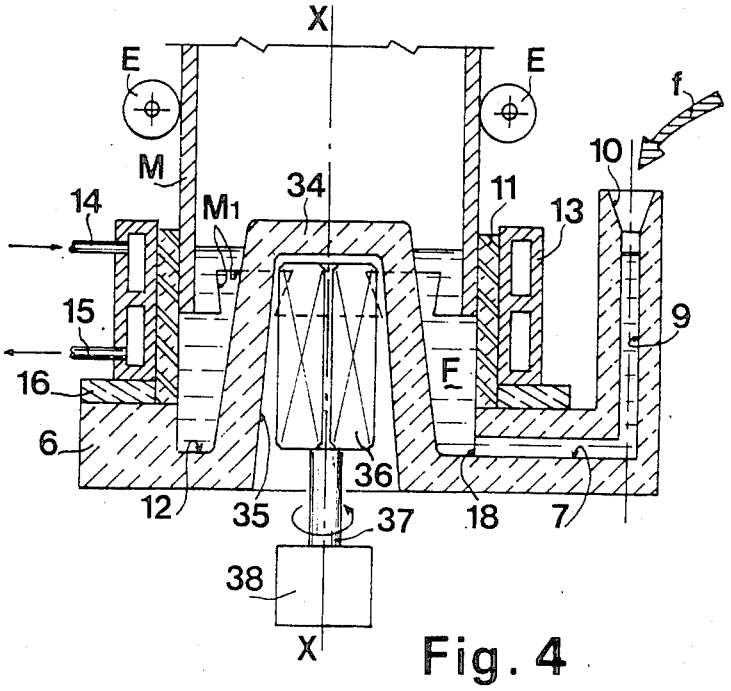

Variation of FIG. 4

In an embodiment similar to that of FIG. 1 but comprising certain differences, the so called "hydraulic" means for setting the molten cast-iron in slow rotation are replaced by magnetic means.

On account of the space taken up by these magnetic means, as will be seen hereafter, the aforesaid double supply of molten cast-iron is replaced by a single supply, through the vertical passage 9, after eliminating the supply by means of a teapot type ladle under gas pressure.

A central relief 34 which is blind at its upper end replaces the central relief 17 of FIG. 1. It comprises a cavity 35 housing electro-magnets or magnets 36 supported by a rotary shaft 37 on a vertical axis XX which is that of the central relief 34 and of the crucible and reservoir. Inside the cavity 35, the magnets 36 and the shaft 37 are protected from any contact with the molten cast-iron. The magnets 36 extend over the entire height of the mass of molten cast-iron F. The rotary shaft 37 is set in rotation by a speed-reducer unit 38. The rotation takes place at slow speed as in the preceding case, i.e. at a speed of the order of several revolutions per minute whereas the centrifugation speed is much higher (for example ten times higher for the large diameters to one hundred times higher for the smallest diameters). The supply of molten cast-iron takes place by way of a siphon unit comprising a vertical passage 9, horizontal pipe 7, opening out at the lower end of the annular volume of molten cast-iron comprised between the central relief 34 and the die 11, possibly through a tangential orifice 18 as in FIG. 1. But in this case, on account of the use of magnetic means such as electro-magnets or rotary magnets 36, the tangential orifice 18 is optional. The pipe supplying molten cast-iron may quite simply open into the bottom 12 of the reservoir crucible 11–12.

The formation of the body of the pipe T takes place in the same way as in the preceding example of FIGS. 1 to 3, with the sole difference that the molten cast-iron, from the beginning comes solely from the siphon unit comprising a vertical passage 9 and that the slow rotation of the molten cast-iron is effected either solely by the rotation of the electro-magnets 36 or by the joint action of being set in rotation by the electromagnets 36 and the tangential inlet of molten cast-iron through a tangential orifice 18, if one is provided, as in FIG. 4.

Figure 5:
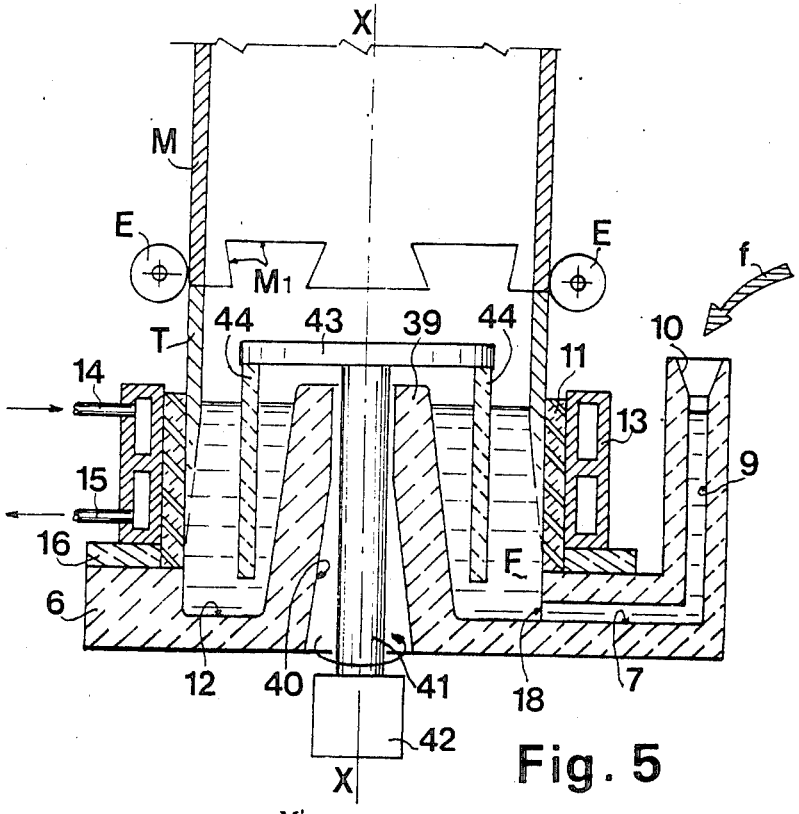

Other means for providing the slow rotation of the molten cast-iron may also be used:

Variation of FIG. 5

In this example, a tubular central relief 39 on the axis XX replaces the preceding reliefs 17 and 34. Passing through the relief 39 from one end to the other is a cylindrical cavity 40 on the axis XX, passing through which with clearance is a rotary shaft 41 on the axis XX set in rotation by a speed-reducer unit 42. At its upper end, the rotary shaft 41 supports either a horizontal plate 43, or horizontal arms 43 on the peripheral edge of which or from the peripheral ends of which vertical graphite bars 44 are suspended, for example of which there are two, three or four or more depending on the dimensions of the plate or arms 43 and the height of which is sufficient in order that their lower end is immersed in the molten cast-iron of the reservoir crucible 11–12 in the vicinity of the bottom 12 of the reservoir crucible 11–12. The supply of molten cast-iron takes place solely by the siphon unit as in the example of FIG. 4, optionally with the tangential orifice 18 at the bottom 12 of the reservoir crucible 11–12. Inside the cavity 40, the shaft 41 is protected from any contact with the molten cast-iron.

The formation of a pipe T of which one sees a solidified initial portion in FIG. 5, attached to the manikin M, takes place as in the two preceding examples, with the sole difference that the molten cast-iron is set in slow rotation by the slow rotation of entrainment bars 44 which cause the bath to rotate about the axis XX.

In all the preceding examples, it will be noted that the body of the pipe (FIG. 5) is obtained without a core, hence the usefulness of setting the cast-iron in slow rotation in order to regularise the thickness of the body on whatever circular section of the said body.

Figure 6:
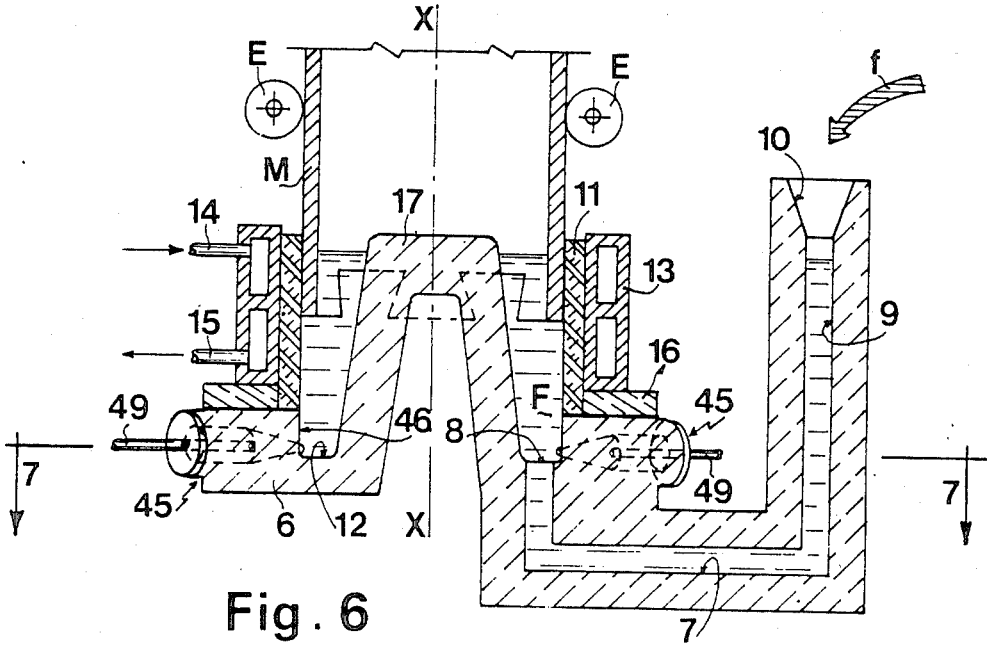
Figure 7:
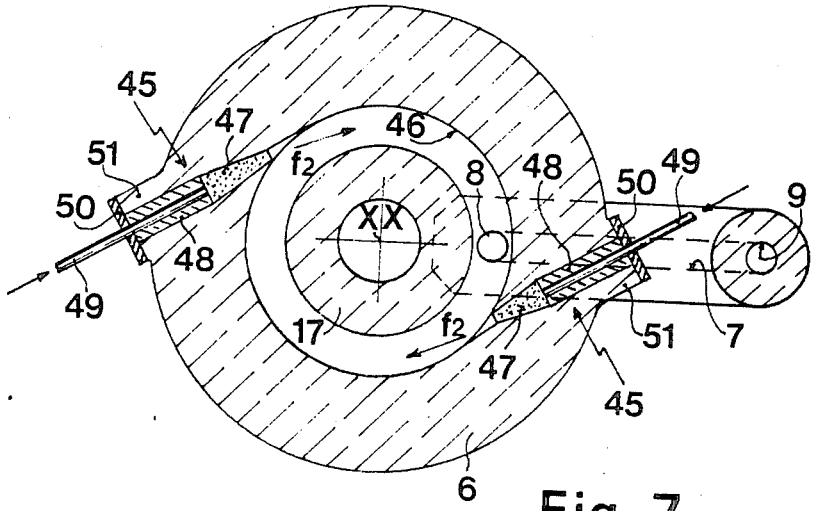
FIG. 7 is a sectional view on line 7—7 of FIG. 6.

Gaseous fluid means for setting the molten cast-iron in rotation at low speed may also be used according to various embodiments illustrated in FIGS. 6 to 11:

Variation of FIGS. 6 and 7

The molten cast-iron is supplied by a siphon unit 7-9-10. The pipe 7 opens out at the bottom 12 of the annular space comprised between the central relief 17 and the die 11 in a non-tangential orifice 8.

In this example, an inert gaseous fluid such as nitrogen or argon is supplied tangentially close to the bottom of the annular volume of molten cast-iron comprised between the die 11 and the central relief 17.

The gaseous fluid for setting the molten cast-iron in rotation is supplied for example through two horizontal nozzles 45 mounted tangentially with respect to the cylindrical cavity of the reservoir crucible and to the cylindrical cavity 46 of the die 11, as an extension of the cylindrical inner wall of the die 11, in the mass of the base 6 and in the vicinity of the bottom 12. Each of the two nozzles 45 comprises a stopper or frustoconical porous jet 47 mounted at the bottom of an equally frustoconical orifice which opens tangentially into the cavity 46, the porous jet 47 consisting of refractory material, for example silico-aluminous material, (type of lining material of large grain size in order to have suitable porosity), a cylindrical sleeve 48 of the same diameter as the large base of the porous jet 47, the sleeve 48 consisting of refractory material and passing through the thickness of the wall of the base 6, coaxially with respect to the jet 47 and along the axis of the cylindrical sleeve 48, a pipe 49 for supplying gaseous fluid as far as the porous jet 47, the pipe 49 being connected to a source of gaseous fluid under pressure which is not shown. A closure plate 50 presses against the outer end face of the cylindrical sleeve 48 and against a boss 51 integral with the base 6 or attached thereto. The pipe 49 passes through the closure plate 50. In this example, there are therefore two nozzles 45, two bosses 51, two pipes 49.

For setting the liquid cast-iron supplied solely through the siphon unit in rotation at slow speed, the blowing-in of an inert gaseous fluid such as nitrogen or argon through the two tangential nozzles 45 pushes the molten cast-iron contained in the reservoir crucible progressively in a slow movement of rotation in the direction of arrows F2 (FIG. 7). By simply varying the pressure of the gaseous fluid, the speed of rotation of the molten cast-iron is regulated. This blowing-in of an inert gas is carried out in the form of fine bubbles distributed in the molten cast-iron by virtue of the porous jets 47 interposed between the pipes 49 and the molten cast-iron.

Figure 8:
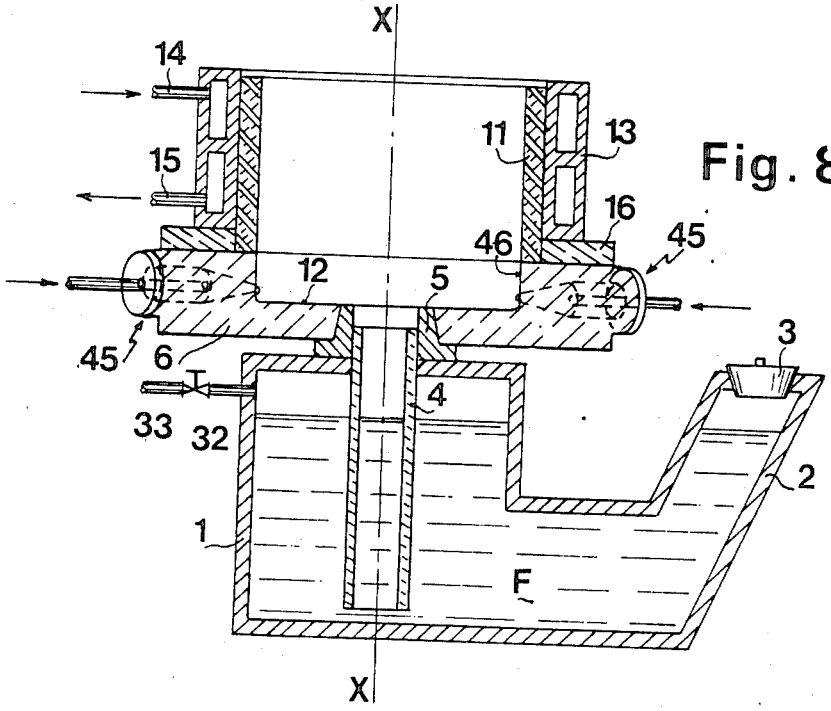
FIG. 8 is a diagrammatic sectional view similar to FIG. 1 of a variation with gaseous means for setting the cast-iron in rotation.

Variation of FIG. 8

The device for setting the molten cast-iron F in rotation by way of a pair of tangential nozzles 45 for blowing in an inert gaseous fluid, is the same as in FIGS. 6 and 7. Only the method of supplying the molten cast-iron is different, the latter being effected by a teapot type ladle 1 under gaseous pressure and by way of a vertical casting tube 4 along the axis XX, as shown in FIG. 1. There is no siphon unit. Neither is there a central relief 17, so that the volume of molten cast-iron F contained in the reservoir crucible 11–12 is no longer annular, but cylindrical, the base 12 itself no longer being annular. The frustoconical nozzle 5 and the upper edge of the bottom casting tube 4 thus open into the base of the vat 12 of the reservoir crucible 11–12. Eliminating the central relief 17 is justified when casting a tube of small diameter.

In the examples of FIGS. 1 to 3, the central relief 17 may also be eliminated for casting a tube T of small diameter. On the other hand, in the example of FIG. 4, the central relief 34 is indispensable for serving as a housing for an electro-magnet 36 or several electromagnets 36 serving to create a magnetic field rotating in the annular volume of molten cast-iron contained in the reservoir crucible 11–12, over the entire height of the said reservoir crucible. The central relief 39 is also necessary in the example of FIG. 5 for the passage of the shaft 31 rotating refractory bars 44 for producing the rotation of the cast-iron.

It should be noted that in the absence of the central relief 17, the energy required for producing the slow rotation of a greater mass of molten cast-iron than when the volume of cast-iron is annular, is also greater, which results in an increase in pressure and the rate of flow of inert gaseous fluid through the nozzles 45.

Figure 9:
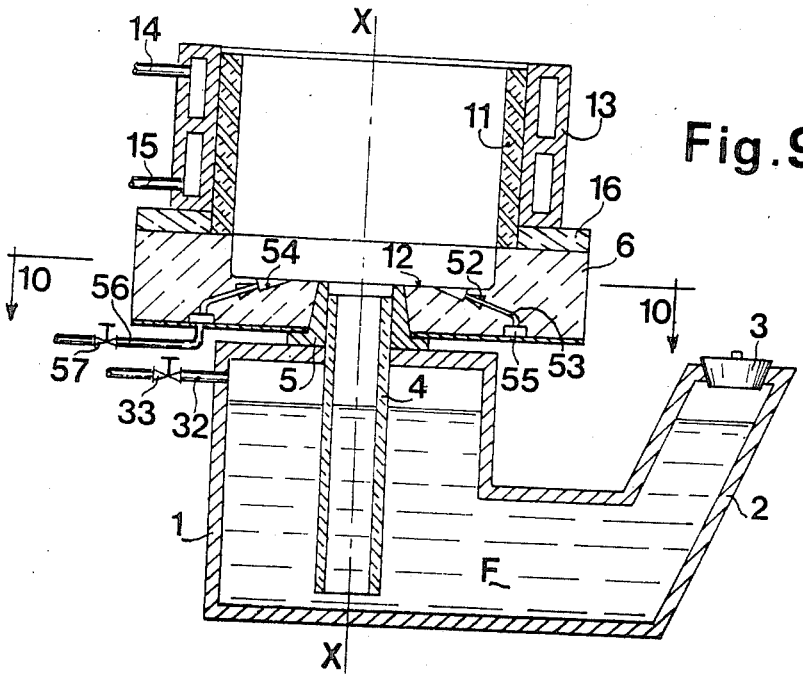
FIG. 9 is a diagrammatic sectional view similar to FIG. 1, of another variation with gaseous means for setting the cast-iron in rotation.
Figure 11:
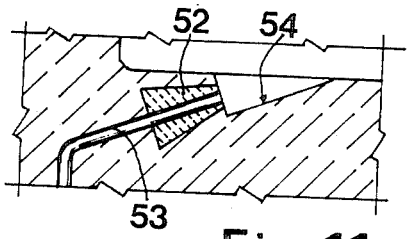
FIG. 11 is a partial enlarged view of a gaseous fluid injector used in the apparatus of FIGS. 9 and 10.
Figure 10:
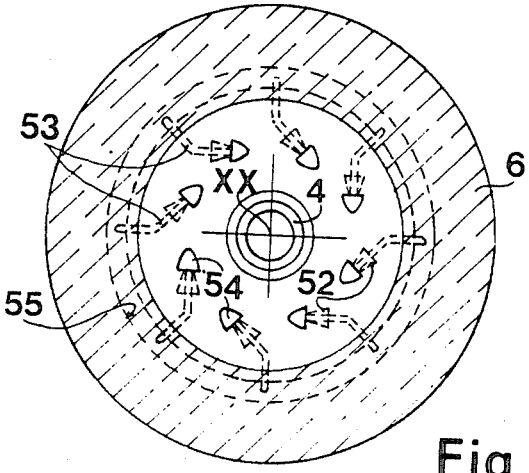
FIG. 10 is a sectional view on line 10—10 of FIG. 9.

Other means also exist for setting the cast-iron in slow rotation by a gaseous fluid supplied tangentially:

Variation of FIGS. 9, 10 and 11

Instead of introducing the gaseous fluid through tangential nozzles 45 comprising a porous stopper 47, tangential injection nozzles are used blowing the inert gaseous fluid directly into the molten cast-iron contained in the reservoir crucible 11–12. Each injection nozzle is constituted by a frustoconical jet of refractory material and passing through which is a pipe 53, the latter opening tangentially into a mouthpiece 54 which is flush with the base 12 of the vat of the reservoir crucible 11–12 which is devoid of a central relief. In this example there are eight tangential injection nozzles 52. Each supply pipe 53 of an injection nozzle 52 opens into a circular groove 55 serving as a distributor for inert gas under pressure. A single external pipe 56 controlled by a valve 57 supplies the inert gaseous fluid under pressure to the circular groove 55. The circular groove for the distribution of inert gaseous fluid 55 is provided in the base 6, in the lower part of the latter. The molten cast-iron is supplied as in the example of FIG. 8 by way of a teapot type ladle and bottom casting tube 4 opening into the bottom 12 of the reservoir crucible 11–12 along the axis XX of the said reservoir crucible.

In contrast to the nozzles 45 comprising a porous stopper 47 which blow in numerous small gas bubbles, the injection nozzles 52 blow large gas bubbles into the molten cast-iron. But since the nozzles 52 open into the base 12 of the reservoir crucible 11–12, instead of opening out on the cylindrical wall of the reservoir crucible 11–12, they reduce the friction of the molten cast-iron rotating on the base 12. In addition, if gas bubbles are injected at high speed, the kinetic energy for the rotation of the molten cast-iron is greater.

Figure 12:
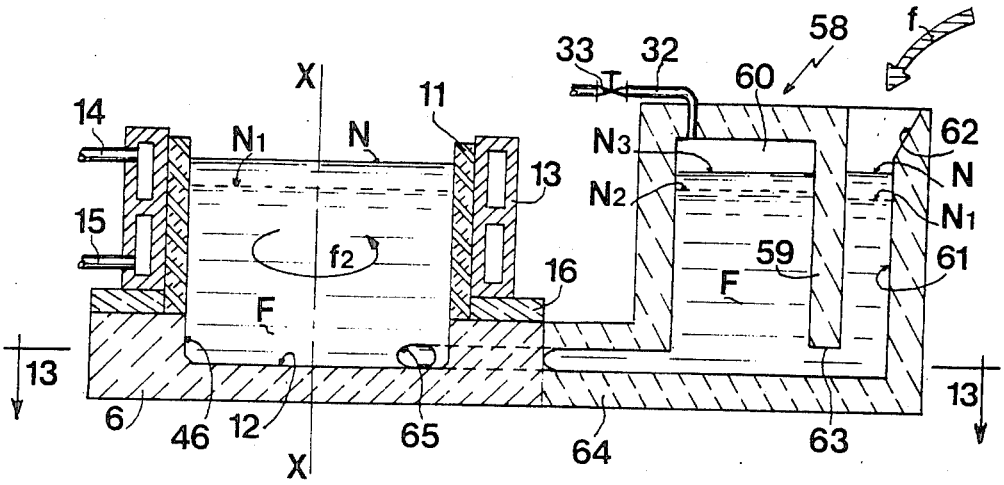
FIG. 12 is a diagrammatic sectional view similar to FIG. 1 of a variation of the apparatus according to the invention with a tangential supply of molten cast-iron and means for the rhythmic pulsation of the said supply.
Figure 13:
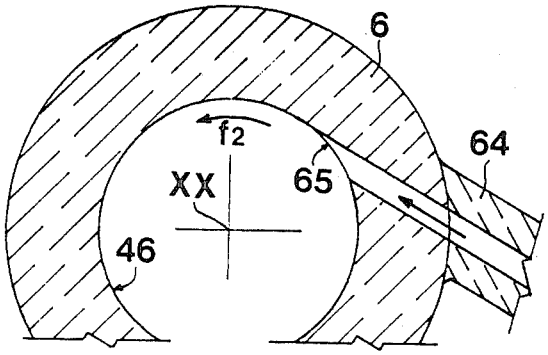
FIG. 13 is a sectional view of line 13—13 of FIG. 12.
Figure 14:
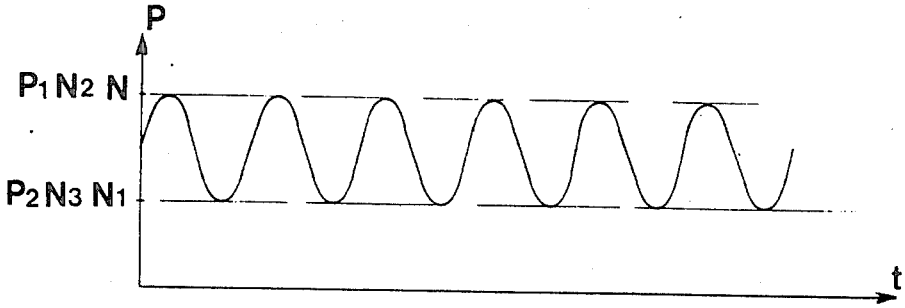
FIG. 14 is a diagram of the pulsations of the level of molten cast-iron as a function of time.

Finally, other means which may be termed hydraulic and pulsatory have been conceived for setting the molten cast-iron in slow rotation in the reservoir crucible 11–12:

Variation of FIGS. 12 to 14

Like FIG. 1, this variation uses tangential supply means. In this example, the central relief 17 creating an annular volume of molten cast-iron in the reservoir crucible 11–12 has disappeared, but it could equally well be present. The existence or absence of the central relief 17 depends on the diameter of the pipe to be formed. In this embodiment, the tangential supply of molten cast-iron close to the bottom 12 of the reservoir crucible 11–12 is achieved by a special siphon-unit device comprising a ladle 58 which is under gas pressure. The ladle 58 for molten cast-iron F is of the type comprising a vertical partition 59, a chamber 60 having a closed roof, receiving the gas pressure at its upper end through a conduit 32 controlled by a valve 33, and a shaft 61 open at its upper end in the form of a funnel 62 for the filling of molten cast-iron in the direction of arrow f. The chamber 60 and the filling shaft 61 are connected by an orifice 63 provided in the lower part of the partition 59. The ladle 58 comprises in the lower part of the chamber 60 a horizontal or roughly horizontal casting spout 64 whereof the casting pipe is connected to the base 6 and opens tangentially into the cylindrical cavity 46 of the reservoir crucible 11-12, close to the bottom 12 of the said reservoir crucible by way of a tangential orifice 65.

The level of molten cast-iron in the reservoir crucible 11,12 may vary between an upper level N situated at the upper end of the die 11 and a lower level N1 situated below the level N, not far from the top of the die 11; the same upper and lower levels N and N1 in the shaft 61 of the ladle 58 corresponding to this same upper level N and lower level N1 in the die 11 due to the effect of communicating vessels by way of the orifice 63 and the casting spout 64. On the other hand, corresponding to this upper level N and lower level N1 in the die 11 is a lower level N2 in the chamber 60 and an upper level N3 which are different from N and N1. In order to obtain the upper level N corresponding to the lower level N2 in the chamber 60 under gas pressure, a maximum gas pressure P1 is required, whereas in order to obtain the lower level N1 in the die 11, corresponding to the upper level N3 in the chamber 60 of the ladle 58, a minimum gas pressure P2 is required.

In order to manufacture a pipe, one proceeds as described in the first example, using a manikin (not shown) at the beginning: maximum gas pressure P1 is admitted into the chamber 60 of the ladle 58, without any pulsation of this pressure, in order to allow the cast-iron to rise in contact with the manikin M for the purpose of good engagement, which causes a drop in the level of molten cast-iron from N3 to N2.

Then, in order to replace with molten cast-iron that which has solidified in contact with the manikin M, the level is raised from N1 to N in the reservoir crucible by introducing molten cast-iron in the direction of arrow f into the shaft 61 of the ladle 58. Then the gas pressure in the chamber 60 is varied periodically and regularly by way of the pipe 32, between the maximum value P1 and a minimum value P2 whilst continuing the renewal of molten cast-iron in the shaft 61 during the gradual extraction. Pulsation of the gas pressure is carried out according to the sinusoidal curve of FIG. 14 which is a diagram of the variation of gas pressure P admitted through the pipe 32 into the chamber 60 as a function of time t. The levels N in the die and N2 in the chamber 60 correspond respectively to the maximum pressure P1 and the levels N3 in the chamber 60 and N1 in the die 11 correspond respectively to the minimum pressure P2. This pulsation of gas pressure which is accompanied by a pulsation of the level of molten cast-iron in the reservoir crucible creates a system of pumping molten cast-iron arriving tangentially through the orifice 65. This system of pumping or pulsation or periodic variation of the gas pressure for the tangential supply of the molten cast-iron creates a slow rotation of the molten cast-iron in the direction of arrow f2 in the reservoir crucible. By regulating the frequency of pulsation and the amplitude of pulsation, i.e. the values of the pressures P1 and P2 (FIG. 14), thus the levels N, N2 and N1, N3, the speed of rotation of the molten cast-iron is regulated precisely and a uniform thickness of tube formed is thus obtained.

We claim:

1. An apparatus for the continuous vertical extraction casting of pipes from spheroidal graphite cast iron, comprising:

(a) a cylindrical reservoir crucible (11, 12) for molten cast iron, (b) cooling means (13) surrounding an outer circumference of the crucible, (c) means for supplying molten cast iron to the crucible, and (d) means for slowly rotating a mass of molten cast iron (F) in the crucible to ensure a constant wall thickness of pipes vertically extracted from the crucible over their entire peripheries, said rotating means comprising:

(1) a central relief (34) upstanding from a base (12) of the crucible and coaxial therewith, (2) a blind cavity (35) defined within the relief, (3) a vertically oriented shaft (37) extending into the cavity from a lower end thereof, (4) magnet means (36) mounted to the shaft and disposed within the cavity, said magnet means extending vertically over substantially the entire height of the mass of molten cast iron in the crucible, and (5) means (38) for slowly rotating the shaft and magnet means mounted thereto.

2. Apparatus according to claim 1, wherein the rotating means further comprises a feed pipe (7) for the supply of molten cast iron into a lower part of the crucible (11–12), said feed pipe having a tangentially oriented outlet orifice (18).

3. An apparatus for the continuous vertical extraction casting of pipes from spheroidal graphite cast iron, comprising:

(a) a cylindrical reservoir crucible (11, 12) for molten cast iron, (b) cooling means (13) surrounding an outer circumference of the crucible, (c) means for supplying molten cast iron to the crucible, and (d) means for slowly rotating a mass of molten cast iron (F) in the crucible to ensure a constant wall thickness of pipes vertically extracted from the crucible over their entire peripheries, said rotating means comprising:

(1) a central relief (39) upstanding from a base (12) of the crucible and coaxial therewith, and extending upwardly to a height greater than the level of molten cast iron in the crucible, (2) an axial bore (40) extending through the relief, (3) a verticaly oriented shaft (41) extending through the bore, (4) a horizontal member (43) extending radially outwardly from an upper end of the shaft, above a top of the relief, (5) a plurality of graphite bars (44) extending vertically downwardly from opposite outer ends of the horizontal member into the molten cast iron to a depth proximate the crucible base, and (6) means (42) for slowly rotating the shaft and graphite bars mounted thereto.

4. Apparatus according to claim 3, wherein the rotating means further comprises a feed pipe (7) for the supply of molten cast iron into a lower part of the crucible (11–12), said feed pipe having a tangentially oriented outlet orifice (18).

* * * * *